US005205256A

United States Patent [19]

Dobler et al.

[11] Patent Number: 5,205,256

[45] Date of Patent: Apr. 27, 1993

[54] FUEL INJECTION PUMP FOR INTERNAL COMBUSTION ENGINES

[75] Inventors: Klaus Dobler, Gerlingen; Hansjörg Hachtel, Weissach, both of Fed. Rep. of Germany

[73] Assignee: Robert Bosch GmbH, Stuttgart, Fed. Rep. of Germany

[21] Appl. No.: 671,862

[22] PCT Filed: Aug. 1, 1989

[86] PCT No.: PCT/DE89/00498

§ 371 Date: Apr. 1, 1991

§ 102(e) Date: Apr. 1, 1991

[87] PCT Pub. No.: WO90/03511

PCT Pub. Date: Apr. 5, 1990

[30] Foreign Application Priority Data

Oct. 1, 1988 [JP] Japan ..... 3833398

[51] Int. Cl.[5] ..... F02D 31/00

[52] U.S. Cl. ..... 123/357; 123/503; 123/494

[58] Field of Search ..... 123/357, 358, 359, 449, 123/494, 503; 73/119 A

[56] References Cited

U.S. PATENT DOCUMENTS

| | | | |
|---|---|---|---|
| 3,841,285 | 10/1974 | Müller | 123/357 |
| 4,036,193 | 7/1977 | Kobayashi | 123/357 |
| 4,212,279 | 7/1980 | Ohtani | 123/357 |
| 4,346,688 | 8/1982 | Kaibara | 123/357 |
| 4,380,221 | 4/1983 | Eheim | 123/357 |
| 4,393,835 | 7/1983 | Eheim | 123/357 |
| 4,425,889 | 1/1984 | Hachitani | 123/357 |
| 4,461,255 | 7/1984 | Eheim | 123/357 |
| 4,465,044 | 8/1984 | Yasuhara | 123/357 |
| 4,506,545 | 3/1985 | Yamada | 123/503 |
| 4,531,491 | 7/1985 | Iiyama | 123/357 |

FOREIGN PATENT DOCUMENTS

| | | | |
|---|---|---|---|
| 2528496 | 12/1983 | France . | |
| 0222967 | 12/1983 | Japan | 123/503 |
| 0046330 | 3/1984 | Japan | 123/503 |
| 0125755 | 7/1985 | Japan | 123/357 |
| 2034401 | 6/1980 | United Kingdom . | |
| 2136060 | 9/1984 | United Kingdom . | |

*Primary Examiner*—Carl S. Miller
*Attorney, Agent, or Firm*—Michael J. Striker

[57] ABSTRACT

Fuel injection pump for internal combustion engines comprising a displacement pickup for determining the position of control elements arranged in a pump housing. The displacement pickup comprises a movable part, which is arranged in the pump housing and is connected with the control element, and a stationary part which is arranged on the outside of the pump housing. The position of the movable part of the displacement pickup is determined by the stationary part by means of a measuring process which measures in a contactless manner, e.g. by means of the induction or eddy current principle.

12 Claims, 3 Drawing Sheets

FUEL INJECTION PUMP FOR INTERNAL COMBUSTION ENGINES

SUMMARY OF THE INVENTION

The present invention relates to fuel injection pump for internal combustion engines.

More particularly, it relates to a fuel injection pump which has a pump interior space enclosed by a pump housing and at least one control element arranged in the pump housing, and a displacement pickup assigned to the latter. It is known from DE-OS 31 48 596 to determine the position of a control element arranged in a pump housing by means of a potentiometer pickup. The control element is actuated by an adjusting shaft and the position of the control element is determined via the adjusting shaft by means of the potentiometer pickup. The potentiometer pickup is connected with measuring devices located outside of the pump housing via electrical connection lines. The potentiometer pickup has the disadvantage that it works with mechanical sliding contacts which are subject to wear. In order to be able to operate the potentiometer pickup in a space filled with fuel, special measures are required, e.g. with respect to the selection of work material. It is also very expensive to guide the electrical lines through the pump housing so as to be pressure-tight.

SUMMARY OF THE INVENTION

Accordingly, it is an object of the present invention to provide a fuel injection pump for internal combustion engines which avoids the disadvantages of the prior art.

In keeping with these objects and with others which will become apparent hereinafter, one feature of the present invention resides, briefly stated, in a fuel injection pump in which a stationary electric part of the displacement pickup is arranged on the outside of the pump housing and a movable mechanical part of the displacement pickup is arranged in the pump interior space as a part which is moved by a control element, and the displacement pickup works according to the principle of a measuring process which measures in a contactless manner.

When the fuel injection pump is designed in accordance with the present invention, is has the advantage that the position of the control element is determined by a displacement pickup which works by means of measuring process which measures in a contactless manner and in which, accordingly, no wear occurs in the displacement pickup. The movable part of the displacement pickup arranged in the pump housing can easily be operated in the fuel and, as a result of the measuring process which measures in a contactless manner, need not be connected via electrical connection lines with the pickup stationary part arranged outside the pump housing and having electrical components.

In accordance with another feature of the present invention a quantity adjusting member is arranged in the pump interior spaced for controlling the fuel injection quantity delivered under high pressure by a pump plunger. The quantity adjusting member is adjustable via a shaft which acts at the quantity adjusting member by a driver which is formed on eccentrically at the latter. The movable part is connected with the shaft on the side of the shaft facing the pump housing.

In accordance with still another feature of the present invention, the movable part is connected with the shaft so as to be fixed with respect to rotation relative to it and is arranged at a slight distance from the pump housing. The movable part is constructed as a structural component part which projects on one side eccentrically relative to the longitudinal axis of the shaft and extends parallel relative to the wall of the housing at which the stationary part is externally arranged.

A further feature of the present invention is that the movable part is connected with the shaft via a thread, wherein the movable part is arranged in the pump housing so a to be secured against rotation relative to it and projects with a pin-like projection into a cup-shaped portion of the pump housing on which the stationary part is externally arranged.

A further feature of the present invention is that the movable part is connected with the shaft via another driver which is attached eccentrically to the shaft and the movable part projects with a pin-like projection into a cup-shaped portion of the pump housing on which the stationary part of the displacement pickup is arranged externally.

The movable part can be constructed as a hollow cylinder which is connected with the shaft so as to be fixed with respect to rotation relative to it and comprises window-like cutout portions which are arranged so as to be offset relative to one another at the circumference as well as along the longitudinal axis of the hollow cylinder. The sleeve is arranged in the pump housing so as to be fixed with respect to rotation relative to it encloses the hollow cylinder and has openings adapted to the cutout portion of the hollow cylinder. The hollow cylinder and the sleeve project into a cup-shaped portion of the pump housing on which the stationary part of the stationary displacement pickup is arranged externally.

In accordance with a still further feature of the present invention, the fuel injection pump has a quantity adjusting member arranged in the pump interior space for controlling the fuel injection quantity delivered under high pressure by a pump plunger, wherein the movable part is rigidly connected at its one end directly with the quantity adjusting member and projects with its other pin-like end into a cup-shaped portion of the pump housing on which the stationary part of the displacement pickup is arranged externally. As a result, the position of the quantity adjusting member is determined directly and the measurement results are not adulterated due to tolerances of an actuating part arranged between the movable part of the displacement pickup and the quantity adjusting member.

An advantageous construction of the movable part of the displacement pickup for determining the position of an injection adjusting member is obtained when the quantity adjusting member is arranged in the pump housing for controlling the injection time point and the movable part is constructed as a pin-like portion of the injection adjusting member which projects into a cup-shaped portion of the pump housing on which the stationary part of the displacement pickup is arranged externally.

The pump interior space in accordance with another feature of the present invention can be filled with fuel.

Finally, the induction of eddy current principles can be used as measuring principle and the stationary part of the disarmament pickup is at least a coil. In this construction a measuring process by means of which the position of the movable part of the displacement pickup can be determined in a contactless manner is provided.

The novel features which are considered as characteristic for the invention are set forth in particular in the appended claims. The invention itself, however, both as to its construction and its method to operation, together with additional objects and advantages thereof, will be best understood from the following description of specific embodiments when read in connection with the accompanying drawings.

DESCRIPTION OF PREFERRED EMBODIMENTS

Figure 1:
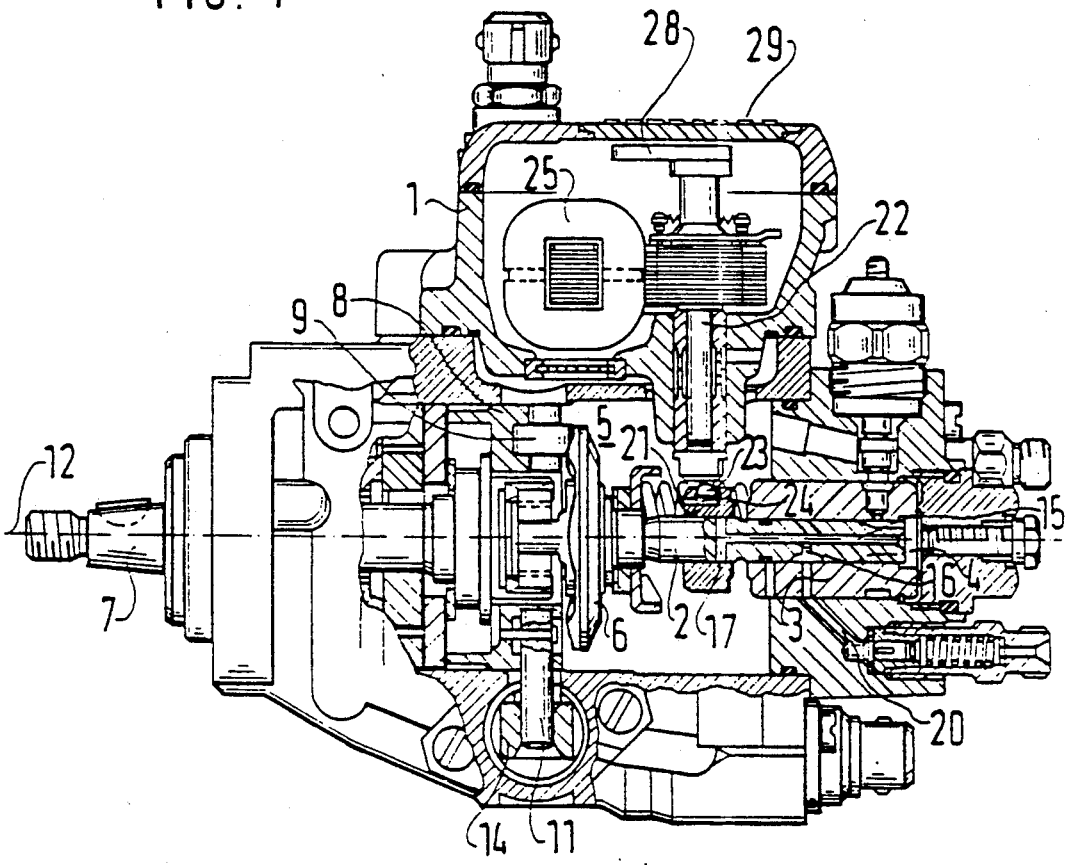
FIG. 1 shows a fuel injection pump in longitudinal section with a first embodiment example of a displacement pickup.

A fuel injection pump shown in FIG. 1 has a pump plunger 2 which is arranged in a pump housing 1 and guided in a pump cylinder 3. The pump plunger 2 encloses a pump work space 4 on one side and projects out of the pump cylinder 3 into a pump interior space 5 filled with fuel on the other side. The pressure of the fuel in the pump interior space 5 is controlled as a function of speed for carrying out the control functions. The pump plunger 2 is connected, via an eccentric disk 6, with a drive shaft 7 on its side projecting into the pump interior space 5. The eccentric disk 6 is supported at the pump housing 1 via rollers 9 arranged in a roller ring 8. The roller ring 8 can be rotated in the pump housing 1 by means of a pin 11 engaging radially in the roller ring 8. The pin 11 engages, with its end located opposite the roller ring 8, in a piston 14 which is movable transversely relative to the longitudinal axis 12 of the fuel injection pump and is actuable against the force of a spring 13 by the pressure of the pump interior space.

The pump plunger 2 is rotated by means of the eccentric disk 6 and simultaneously executes a movement along the longitudinal axis 12 caused by the rollers and the eccentric disk 6. The pump plunger 2 comprises a longitudinal bore hole 15, a transverse bore hole 16 opening into the longitudinal bore hole 15, and a return flow bore hole 17 which passes transversely through the bore hole 15. The longitudinal movement of the pump plunger 2 serves for the high-pressure delivery of a determined quantity of fuel. Delivery ducts 20 in the pump housing which are assigned to the individual engine cylinders are controlled via the longitudinal bore hole 15 and the transverse bore hole 16 by means of the rotational movement of the pump plunger 2. The return flow bore hole 17 is covered by an annular slide 21 serving as a quantity adjusting member until the required fuel quantity is delivered by the pump plunger 2. Then the return flow bore hole 17 emerges from the annular slide 21 and the fuel quantity still delivered by the pump plunger 2 until reaching its top dead center position flows back into the pump interior space 5 via the return flow bore hole 17. The annular slide 21 is displaceable on the pump plunger 2 in the longitudinal direction, so that the fuel injection quantity can be controlled by means of the position of the annular slide 21. The annular slide 21 can be displaced in the longitudinal direction by means of an adjusting shaft 22 which engages in a groove 21 in the outer surface area of the annular slide 21 via a driver 23. The driver is formed on eccentrically at this adjusting shaft 22, and groove 21 extends transversely relative to the longitudinal axis 12. The adjusting shaft 22 is actuated by means of a moving-magnet controlling unit 25, fuel flows around the latter in the pump interior space 5. Information on the instantaneous position of the annular slide 21 is required for regulating the fuel injection quantity. A displacement pickup is used for determining the position of the annular slide 21, which displacement pickup works on the basis of a measurement process measuring in a contactless manner. It comprises a movable mechanical part which is connected with the annular slide 21 and a stationary electrical part which is attached to the outside of the pump housing.

In a first embodiment example of the displacement pickup, shown in FIG. 1, its movable part 28 is connected with the adjusting shaft 22 so as to be fixed with respect to rotation relative to it on the side of the latter 22 facing the pump housing 1. The movable part 28 is constructed as a half-disk which preferably projects radially from the adjusting shaft 22 on one side and extends parallel to the adjoining part of the pump housing 1. The stationary part 29 of the displacement pickup is attached to the outside of the pump housing 1 located opposite the movable part 28.

Figure 2:
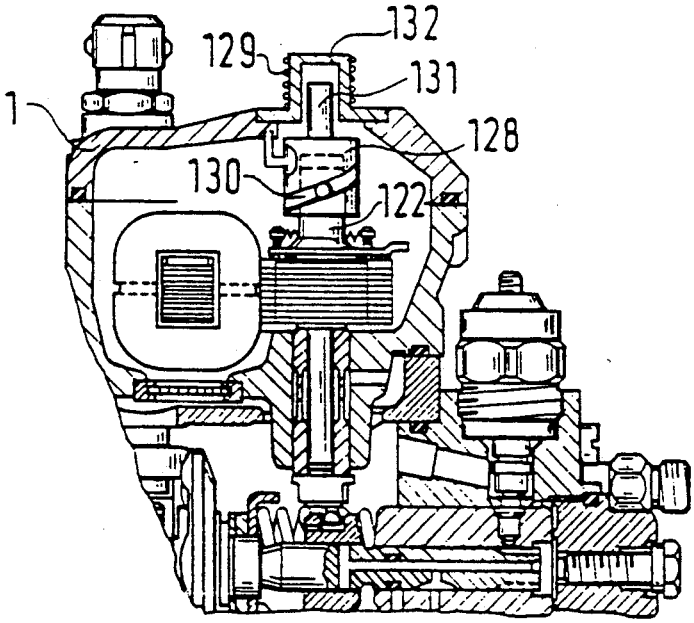
FIG. 2 shows a second embodiment example of the displacement pickup.

In a second embodiment example of the displacement pickup, shown in FIG. 2, the movable part 128 is connected with the adjusting shaft 122 via a coarse thread 130 and is arranged in the pump housing 1 so as to be fixed with respect to rotation. The movable part 128 comprises a pin 131 on the side remote of the adjusting shaft 122. The pin 131 penetrates into a cup-shaped portion 132 of the pump housing 1 on which the stationary part 129 of the displacement pickup is arranged. The rotational movement of the adjusting shaft 122 is transformed via the coarse thread 130 into a longitudinal movement of the movable part 128 of the displacement pickup.

Figure 3:
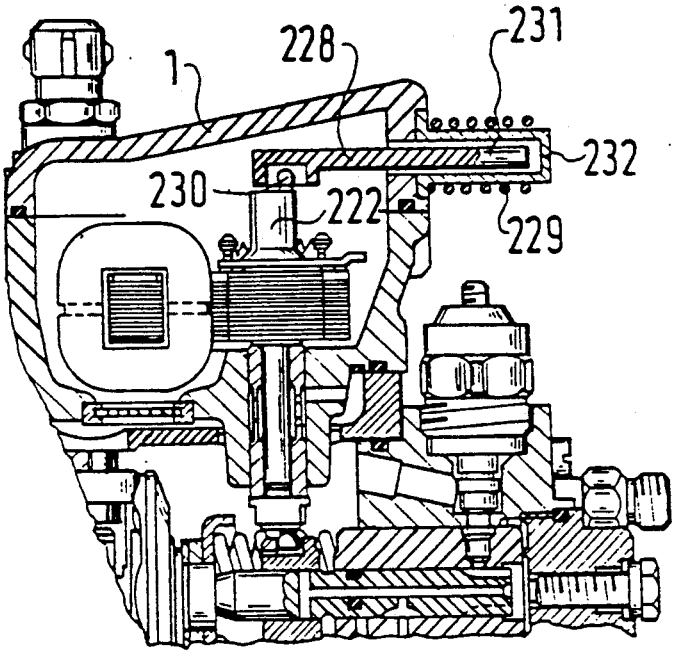
FIG. 3 shows a third embodiment example of the displacement pickup.

In a third embodiment example of the displacement pickup, shown in FIG. 3, the movable part 228 is connected with the adjusting shaft 222 via a driver 230 which is formed on eccentrically at the adjusting shaft 222. The movable part 228 projects vertically from the adjusting shaft 222 on one side and projects with its pin-like end 231 into a cup-shaped portion 232 of the pump housing 1 on which the stationary part 229 of the displacement pickup is arranged and is axially displaced in the cup-shaped portion 232 during rotation of the adjusting shaft 222.

Figure 4:
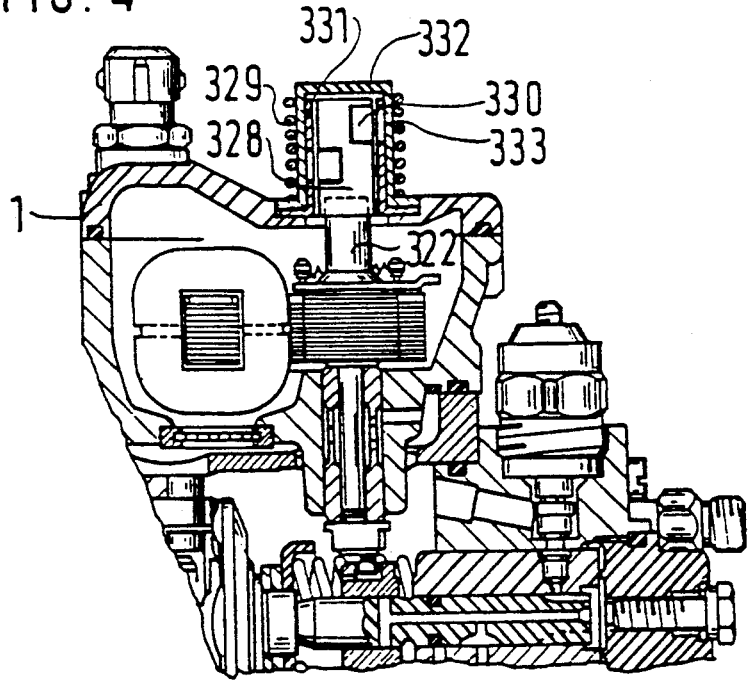
FIG. 4 shows a fourth embodiment example of the displacement pickup.

In a fourth embodiment example of the displacement pickup, shown in FIG. 4, the movable part 328 is constructed as a hollow cylinder which is placed on the adjusting shaft 322 so as to be fixed with respect to rotation. The hollow cylinder 328 comprises two window-like cut out portions 330 which are arranged so as to be offset relative to one another at its circumference as well as along its longitudinal axis. The hollow cylinder 328 projects into a cup-shaped portion 332 of the pump housing 1, wherein a sleeve 331 is arranged between the hollow cylinder 328 and the cup-shaped portion 332. The sleeve 331 is rigidly connected with the pump housing 1 and comprises two openings 333 adapted to the cut out portions 330 of the hollow cylinder 328. The openings 333 are arranged at the same height of the longitudinal axis of the hollow cylinder 328 as the cut out portions 330. They are also arranged in the circumferential direction e.g. in such a way that one cut out portion 330 is increasingly opened by means of one opening 333 during the rotation of the adjusting shaft 322, while the other cut out portion 330 is increasingly closed by means of the sleeve 331. The stationary part 329 of the displacement pickup is attached on the outside of the cup-shaped portions 332.

Figure 5:
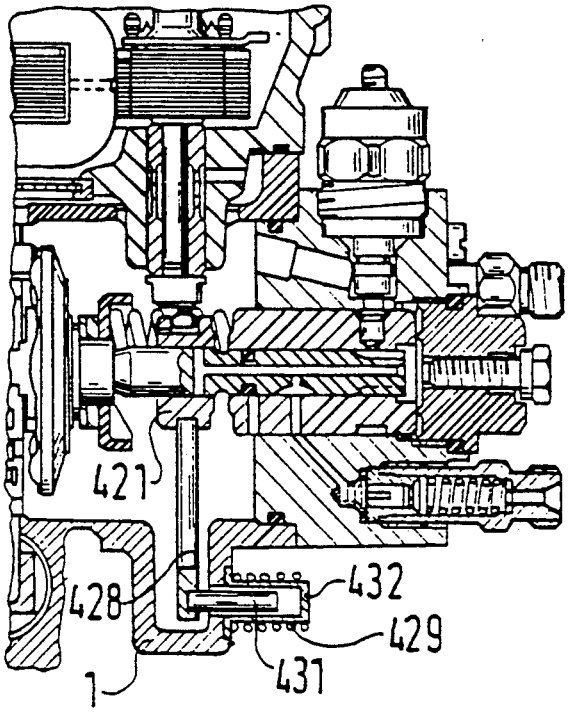
FIG. 5 shows a fifth embodiment example of the displacement pickup.

In a fifth embodiment example of the displacement pickup, shown in FIG. 5, the movable part 428 is rigidly connected with the annular slide 421. A pin-like end 431 of the movable part 428 extending parallel to the adjusting direction of the annular slide 421 projects into a cup-shaped portion 433 of the pump housing 1 on which the stationary part 429 of the displacement pickup is arranged. The cup-shaped portion 432 can instead be attached at the circumference of the pump housing 1, where the attachment is most favorable for reasons relating to space. Due to the direct connection of the movable part 428 of the displacement pickup with the annular slide 421, its position can be determined in a particularly accurate manner, since no tolerances of intermediately connected structural component parts occur.

Figure 6:
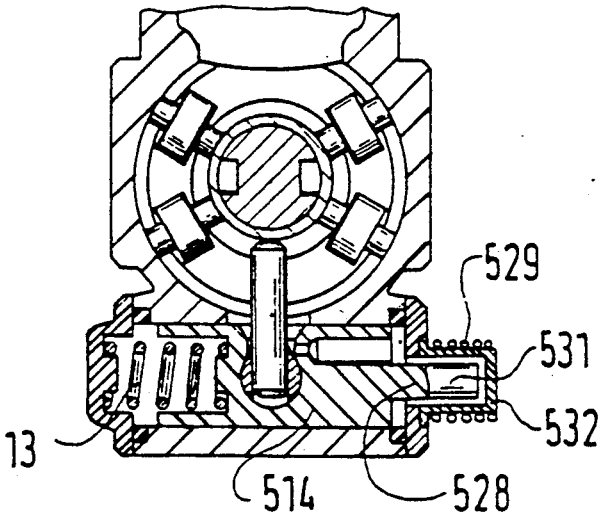
FIG. 6 shows the fuel injection pump in cross section along line VI—VI in FIG. 1 with a sixth embodiment example of the displacement pickup.

In a sixth embodiment example of the displacement pickup, shown in FIG. 6, the movable part 528 is constructed as a pin-like end 531 of an injection adjuster piston 514. The piston 514 serves as injection adjusting member and projects into a cup-shaped portion 532 of the pump housing 1 on which the stationary part 529 of the displacement pickup is arranged.

The induction or eddy current principles can be used as measuring principle, wherein the stationary part of the displacement pickup is at least a coil, the movable part comprises electrically conductive material, and the pump housing in the area of the coil comprises material which is not electrically conductive, such as plastic or ceramic. In the induction principle, a non-ferromagnetic metal can also be used as coil body.

It will be understood that each of the elements described above, or two or more together, may also find a useful application in other types ofconstructions It will be understood that each of the elements described above, or two or more together, may also find a useful application in other types of constructions differing from the types descried above.

While the invention has been illustrate and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapted it for various applications without omitting features that, from the standpoint or prior art, fairly constitute essential characteristics of the generic or specific aspects of this invention.

What is claimed as new and desired to be protected by Letters Patent is set forth in the appended claims.

1. A fuel injection pump for internal combustion engines, comprising a pump housing which encloses a pump interior space; at least one control element arranged in said pump housing; a displacement pickup, said displacement pickup having a stationary electrical part arranged outside of said pump housing and a movable mechanical part arranged in said pump interior space as a part which is moved by said control element, said displacement pickup operating in accordance with the principle of a measuring process which measures in a contactless manner; a pump plunger; a shaft; and a quantity adjusting member arranged in said pump interior space for controlling a fuel injection quantity delivered under high pressure by said pump plunger, said quantity adjusting member being adjustable via said shaft which acts at said quantity adjusting member, said movable part of said displacement pickup being connected with said shaft on a side of said shaft facing said pump housing, said shaft having a longitudinal axis, said pump housing having a wall at which said stationary part of said displacement pickup is externally arranged, said movable part of said displacement pickup being connected with said shaft so as to be fixed with respect to rotation relative to it and being arranged at a slight distance from said pump housing, said movable part of said displacement pickup being constructed as a structural component part which projects on one side eccentrically relative to said longitudinal axis of said shaft and extends parallel relative to said wall of said housing at which the stationary part is externally arranged.

2. A fuel injection pump for internal combustion engines, comprising a pump housing which encloses a pump interior space; at least one control element arranged in said pump housing; a displacement pickup, said displacement pickup having a stationary electrical part arranged outside of said pump housing and a movable mechanical part arranged in said pump interior space as a part which is moved by said control element, said displacement pickup operating in accordance with the principle of a measuring process which measures in a contactless manner; a pump plunger; a shaft; and a quantity adjusting member arranged in said pump interior space for controlling a fuel injection quantity delivered under high pressure by said pump plunger, said quantity adjusting member being adjustable via said shaft which acts at said quantity adjusting member, said movable part of said displacement pickup being connected with said shaft on a side of said shaft facing said pump housing, said movable part being formed as a hollow cylinder which is connected with said shaft so as to be fixed with respect to rotation relative to it and has window-like cutout portions arranged so as to be offset relative to one another at a circumference and also along a longitudinal axis of said hollow cylinder.

3. A fuel injection pump for internal combustion engines, comprising a pump housing which encloses a pump interior space which is filled with fuel; at least one control element arranged in said pump housing; a displacement pickup, said displacement pickup having a stationary electrical part arranged outside of said pump housing and a movable mechanical part arranged in said pump interior space as a part which is moved by said control element, said displacement pickup operating in accordance with the principle of a measuring process which measures in a contactless manner.

4. A fuel injection pump as defined in claim 3; and further comprising a pump plunger; a shaft; and a quantity adjusting member arranged in said pump interior space for controlling a fuel injection quantity delivered under high pressure by said pump plunger, said quantity adjusting member being adjustable via said shaft which acts at said quantity adjusting member, said movable part of said displacement pickup being connected with said shaft on a side of said shaft facing said pump housing.

5. A fuel injection pump as defined in claim 4; and further comprising a driver which is formed eccentrically on said quantity adjusting member, said quantity adjusting member being adjustable via said shaft which acts at said quantity adjusting member via said driver.

6. A fuel injection pump as defined in claim 4; wherein said pump housing on which said stationary part of said displacement pickup is externally arranged has a cup-shaped portion, said movable part of said displacement pickup being connected with said shaft by a thread and arranged on said pump housing so as to be secured against rotation relative to it, said movable part of said displacement pickup having a pin-like projection with which it projects into said cup-shaped portion of said pump housing.

7. A fuel injection pump as defined in claim 5; and further comprising another driver which is attached eccentrically to said shaft, said housing on which said stationary part of said displacement pickup is arranged having a cup-shaped portion, said movable part of said displacement pickup being connected with said shaft via said another driver, and having a pin-like projection with which it projects into said cup-shaped portion of said pump housing.

8. A fuel injection pump as defined in claim 2; and further comprising a sleeve arranged in said pump housing so as to be fixed with respect to rotation relative to it, said sleeve enclosing said hollow cylinder and having openings corresponding to said cutout portions of said hollow cylinder, said pump housing on which said stationary part of said displacement pickup is arranged externally being provided with a cup-shaped portion such that said hollow cylinder and said sleeve project into said cup-shaped portion of said pump housing.

9. A fuel injection pump as defined in claim 3, wherein said pump housing on which said stationary part of said displacement pickup is arranged has a cup-shaped portion; and further comprising a pump plunger; and a quantity adjusting member arranged in said pump interior space for controlling a fuel injection quantity delivered under high pressure by said pump plunger, said movable part of said displacement pickup being rigidly connected with its one end directly with said quantity adjusting member and having another pin-like end with which it projects into said cup-shaped portion of said pump housing.

10. A fuel injection pump as defined in claim 3, wherein said pump housing on which said stationary part of said displacement pickup is arranged externally has a cup-shaped portion; and further comprising a quantity adjusting member arranged in said pump housing for controlling an injection time point, said movable part of said displacement pickup being formed as a pin-like portion of said quantity injection adjusting member and projecting into said cup-shaped portion of said pump housing.

11. A fuel injection pump as defined in claim 3, wherein said stationary part of said displacement pickup is formed as a member which is adapted to a measuring principle selected from an induction principle and an eddy current principle.

12. A fuel injection pump as defined in claim 11, wherein said stationary part of said displacement pickup is formed as a coil.

* * * * *